United States Patent [19]

Carleton

[11] Patent Number: 5,008,583

[45] Date of Patent: Apr. 16, 1991

[54] HIGH-PRESSURE DISCHARGE LAMP

[75] Inventor: Samuel A. Carleton, Bath, N.Y.

[73] Assignee: U.S. Philips Corporation, New York, N.Y.

[21] Appl. No.: 378,879

[22] Filed: Jul. 12, 1989

[30] Foreign Application Priority Data

Jul. 12, 1988 [NL] Netherlands ..... 8801756
Aug. 17, 1988 [NL] Netherlands ..... 8802034

[51] Int. Cl.[5] ..... H01J 1/02

[52] U.S. Cl. ..... 313/25; 313/560; 315/73

[58] Field of Search ..... 313/25, 35, 59, 61, 313/73, 560; 315/57, 60, 101, 102, 106, 50, 58

[56] References Cited

U.S. PATENT DOCUMENTS 4,117,370 9/1978 Jacobs et al. ..... 315/73

4,144,475 3/1979 Delen et al. ..... 313/25

*Primary Examiner*—Donald J. Yusko
*Assistant Examiner*—Diab Hamadi
*Attorney, Agent, or Firm*—Brian J. Wieghaus

[57] ABSTRACT

The invention relates to a high-pressure sodium discharge lamp provided with a discharge vessel having a longitudinal axis 1 and a diameter D. The discharge vessel is enclosed by an outer envelope. Within the outer envelope a starting circuit is arranged, which has at least a glow starter. According to the invention, the outer envelope is a clear outer envelope and the glow starter is arranged so as to be laterally displaced over a distance of at least D/2 with respect to the discharge vessel. Moreover, the glow starter is shielded for the major part with respect to the discharge vessel by means of a heat shield.

5 Claims, 1 Drawing Sheet

HIGH-PRESSURE DISCHARGE LAMP

BACKGROUND OF THE INVENTION

The invention relates to a high-pressure sodium discharge lamp provided with an elongate discharge vessel enclosing a discharge space and having a longitudinal axis 1 and a diameter D and having a ceramic wall, which is closed at each end by a lead-through member, which is connected on the one hand to a relevant current conductor and on the other hand to a relevant electrode, the lamp further being provided with an outer envelope, which is closed by a lamp cap, and a starting circuit having at least a glow starter being arranged within said outer envelope. The term "ceramic wall" is to be understood herein to mean a wall constituted by translucent crystalline metal oxide, which may be monocrystalline (for example sapphire) or polycrystalline. Known polycrystalline metal oxides in this connection are aluminium oxide and yttrium-aluminium-garnet. In polycrystalline form, the material is sintered to gas-tightness.

A lamp of the kind-mentioned in the opening paragraph is known from U.S. Pat. No. 4,117,370. The known lamp is an efficient light source, which is frequently used. The lamp is provided with an ovoidal outer envelope, which is coated in practice on its inner side with a light-scattering layer. The glow starter is mounted in line with the discharge vessel so as to be enclosed between an end thereof and the mount of the lamp. It is desirable to mount the glow starter near the discharge vessel within the outer envelope because of the comparatively simple production, in contrast, for example, with mounting in the lamp cap.

The known lamp is suitable from a viewpoint of efficiency as a substitute for, for example, high-pressure mercury discharge lamps. If, however, an optimal substitution should be obtained, the substitute lamp should be arranged in an existing luminaire optically in substantially the same position as the original lamp. This means that especially the position of the discharge vessel with respect to the luminaire is of importance. As a measure for determining the position of the discharge vessel, the distance between the lamp cap bottom and the center of the discharge vessel is used. This distance is generally designated as light center length.

The discharge vessel of high-pressure mercury and high-pressure metal halide discharge lamps are considerably shorter than discharge vessels of high-pressure sodium discharge lamps suitable as substitutes. By coating the outer envelope with a light-scattering layer, it is achieved to a considerable extent that the positioning of the discharge vessel with respect to the luminaire in which the lamp is used is of minor importance.

However, a light-scattering layer limits the choice of the shape of the envelope to an ovoidal or similar shape, in order to achieve that the temperature of the light-scattering layer during operation of the lamp remains acceptable.

Although the use of a coated outer envelope has the advantage that positioning of the discharge vessel is not particularly critical, the optical behaviour of such a lamp will still be of lower quality than that of a similar lamp having a clear outer envelope and an optimally positoned discharge vessel. Moreover, the use of a light-scattering layer will always lead to loss of efficiency.

SUMMARY OF THE INVENTION

The invention has for its object to provide a measure by which a high-pressure sodium discharge lamp can be obtained having an improved optical quality, while maintaining an incorporated starting circuit having a comparatively simple construction.

According to the invention, a lamp of the kind mentioned in the opening paragraph is for this purpose characterized in that the outer envelope is a clear outer envelope, in that the glow starter is mounted so as to be laterally displaced over a distance of at least D/2 with respect to the longitudinal axis of the discharge vessel, and in that the glow starter is shielded for the major part with respect to the discharge vessel by means of a heat radiation shield.

The measure permits of obtaining a high-pressure sodium discharge lamp having an incorporated starting circuit and a clear outer envelope, whose light center length corresponds to that of an existing high-pressure lamp having a clear outer envelope. The optical equality of the lamp according to the invention will therefore be improved with respect to the known lamp provided with the light-scattering layer on the outer envelope.

Without further measures being taken, the glow starter is irradiated to a great extent by radiation emitted by the discharge vessel due to the fact that it is mounted laterally with respect to the discharge vessel. This feature results in that it is desirable to shield the glow starter from excessive heating by mounting a heat shield. It is to be preferred to use a heat shield in the form of a ceramic resistor, which limits the current through the starting circuit. Especially for lamps having a comparatively high nominal power, this is favourable.

The invention permits of freely choosing the shape of the outer envelope so that besides the ovoidal shape also tubular shapes, as the case may be provided with a widened central part, may be used.

An embodiment of a lamp according to the invention will be described more fully with reference to the drawing, in which:

DESCRIPTION OF THE PREFERRED EMBODIMENTS

Figure 1:
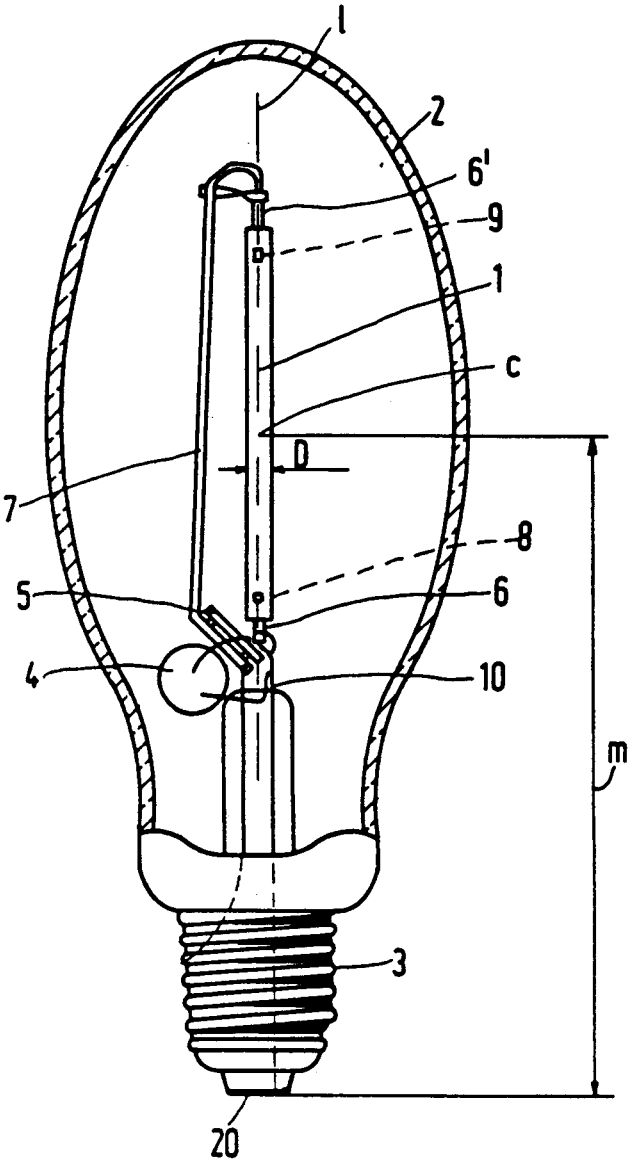
FIG. 1 is an elevation of a lamp according to the invention with an outer envelope broken away.

In FIG. 1, reference numeral 1 designates an elongate discharge vessel enclosing a discharge space and having a longitudinal axis 1 and a diameter D. Reference numeral 2 designates a clear outer envelope, which is provided on one side with a lamp cap 3 with a bottom 20.

Within the outer envelope 2, a starting circuit is arranged, which is constituted by a glow starter 4 and a ceramic resistor 5. The ceramic resistor 5 serves at the same time as a heat radiation shield, by which the glow starter 4 is shielded for the major part with respect to the discharge vessel 1.

The discharge vessel 1 is closed at each end by a lead-through member 6, 6', which is connected on the one hand to a relevant current conductor 10, 7 and on the other hand to a relevant electrode 8, 9.

The center of the discharge vessel, designated by C, is located at a distance m, which is the light center length, from the bottom 20 of the lamp cap 3.

Figure 2:
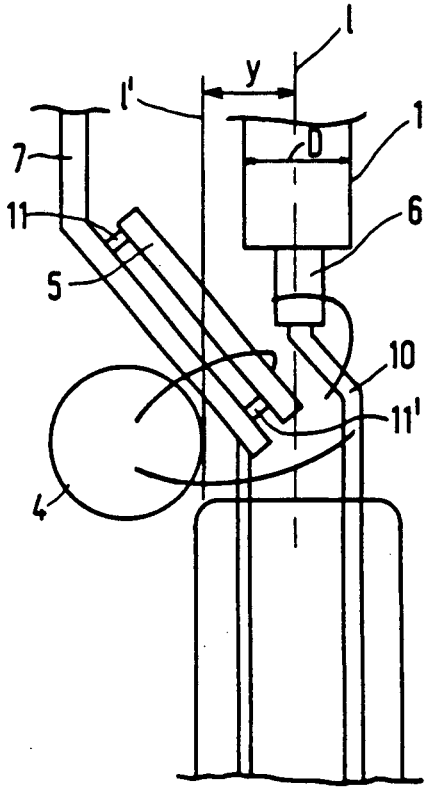
FIG. 2 shows in detail a side elevation of a part of the lamp in FIG. 1.

FIG. 2 shows in detail an end of the discharge vessel 1 with lead-through member 6 and glow starter 4. The parts corresponding to FIG. 1 are provided with corresponding reference numerals. The longitudinal axis of the discharge vessel 1 is designated by 1. The discharge vessel has a outside diameter D.

The glow starts is arranged so as to be laterally displaced over a distance y with respect to the longitudinal axis 1 of the discharge vessel 1. The distance y is 0.8 D in the case shown, as a result of which the requirement of at least 0.5 D is satisfied.

The ceramic resistor is secured by means of supports 11, 11' to the current conductor 7. At least one of the supports 11, 11' at the same time forms an electrically conductive connection between the current conductor 7 and the ceramic resistor 5.

The table below indicates data of practical lamp embodiments. Lamps enumerated by I, III and V are lamps according to the invention, in which the glow starters are mounted so as to be laterally displaced over a distance of 0.8 D with respect to the discharge vessel. Lamps enumerated by II, IV and VI are lamps in which the glow starter is positioned in accordance with the prior art.

TABLE

| lamp number | I | II | III | IV | V | VI |
|---|---|---|---|---|---|---|
| nominal power (W) | 150 | 150 | 250 | 250 | 400 | 400 |
| discharge vessel diameter (mm) | 5.3 | 5.3 | 6.9 | 6.9 | 8.2 | 8.2 |
| discharge vessel length (mm) | 79 | 79 | 88 | 88 | 116 | 116 |
| overall lamp length (mm) | 205 | 215 | 205 | 225 | 285 | 285 |
| light center length (mm) | 127 | 137 | 127 | 141 | 178 | 185 |

The lamp enumerated by I is suitable to replace a high-pressure mercury lamp having a nominal power of 175 W. The light center length of such a high-pressure mercury lamp is 127 mm.

The lamp enumerated by III is suitable to replace a high-pressure mercury lamp having a nominal power of 250 W. The light center length of such a high-pressure mercury lamp is 127 mm.

The lamp enumerated by V has a light center length corresponding to that of a high-pressure sodium discharge lamp having a nominal power of 400 W without an incorporated starting circuit.

I claim:

1. In a high pressure sodium discharge lamp having an outer envelope, and a discharge vessel disposed in said outer envelope in which a discharge is maintained during lamp operation, said discharge vessel having a longitudinal axis 1 and an outside diameter D, and a starting circuit comprising a glow starter within said outer envelope, the improvement comprising:

said outer envelope being clear, said glow starter being mounted so as to be laterally displaced a distance of at least D/2 from the longitudinal axis 1 of the discharge vessel, and shielding means for shielding a substantial portion of said glow starter from heat radiation from said discharge vessel.

2. In a high pressure sodium discharge lamp as claimed in claim 1, characterized in that the heat radiation shielding means is a ceramic resistor, which forms part of the starting circuit.

3. A high pressure sodium discharge lamp, comprising:

a clear outer envelope defining a lamp axis and having a reentrant stem sealing said envelope in a gas-tight manner;

an elongate discharge vessel disposed within said outer envelope in which a discharge is maintained during lamp operation, said discharge vessel having a longitudinal axis 1 aligned with said lamp axis, an outside diameter D, a first end proximate said stem and a second end remote from said stem;

first and second rigid current conductors extending from said stem into said envelope for supporting and energizing said discharge vessel, said first current conductor being connected to said first end of said discharge vessel and said second current conductor extending the length of said discharge vessel and being connected to said second end of said discharge vessel;

a starting circuit comprising a glow starter for initiating a discharge within said discharge vessel, said glow starter being mounted adjacent said stem and spaced a distance of at least D/2 from said longitudinal axis of said discharge vessel; and shielding means for shielding a substantial portion of said glow starter from heat radiation.

4. A high pressure sodium discharge lamp as claimed in claim 3, wherein said starting circuit further comprises a ceramic resistor, and said ceramic resistor being positioned for shielding said glow starter.

5. A high pressure sodium discharge lamp as claimed in claim 4, wherein said glow starter and said ceramic resistor are mounted on said second rigid current conductor.

* * * * *